United States Patent [19]

Brown

[11] Patent Number: 4,999,855

[45] Date of Patent: Mar. 19, 1991

[54] COMBINATION HELMET AND UPPER BODY PROTECTOR

[76] Inventor: Kenneth W. Brown, 51 Park Avenue, St. Catharines, Ontario, Canada, L2P-1R2

[21] Appl. No.: 422,037

[22] Filed: Oct. 16, 1989

[51] Int. Cl.[5] ..... A42B 3/22; A42B 71/10

[52] U.S. Cl. ..... 2/421; 2/424; 2/425

[58] Field of Search ..... 2/2, 9, 424, 425, 421, 2/415

[56] References Cited

U.S. PATENT DOCUMENTS

| | | | |
|---|---|---|---|
| 3,373,443 | 3/1968 | Marietta | 2/9 |
| 4,021,858 | 5/1977 | Neold et al. | 2/9 |
| 4,031,564 | 6/1977 | Wood | 2/9 |
| 4,173,795 | 11/1979 | Lundin et al. | 2/9 X |
| 4,602,385 | 7/1986 | Warren | 2/2 |
| 4,825,476 | 5/1989 | Andrews | 2/2 |

*Primary Examiner*—Daniel M. Yasich

*Attorney, Agent, or Firm*—Richard L. Miller

[57] ABSTRACT

A combination helmet and upper body protector which will cover and protect head, skull, face, chin, back, chest and shoulders of a person and still allow the person to move the head independently and to see and hear therefrom.

3 Claims, 1 Drawing Sheet

COMBINATION HELMET AND UPPER BODY PROTECTOR

BACKGROUND OF THE INVENTION

The instant invention relates generally to enclosure devices and more specifically it relates to a combination helmet and upper body protector for a hockey player or the like.

Numerous enclosure devices have been provided in prior art that are adapted to cover and enclosure the heads and necks of the wearers of the enclosure devices. For example, U.S. Pat. Nos. 1,113,062; 3,562;813 and 4,605,000 all are illustrative of such prior art. While these units may be suitable for the particular purpose to which they address, they would not be as suitable for the purpose of the present invention as hereafter described.

SUMMARY OF THE INVENTION

A primary object of the present invention is to provide a combination helmet and upper body protector that may be used for games or other activities such as welding, skiing, cherry picking, etcetera and will overcome the shortcomings of the prior art devices.

Another object is to provide a combination helmet and upper body protector that includes a cage which is carried on shoulders of a person wearing the invention allowing head of the person to move freely within and still be protected.

An additional object is to provide a combination helmet and upper body protector with a separate skull and chin protector which is worn independently inside the invention for protecting the skull and chin.

A further object is to provide a combination helmet and upper body protector that is simple and easy to use.

A still further object is to provide a combination helmet and upper body protector that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
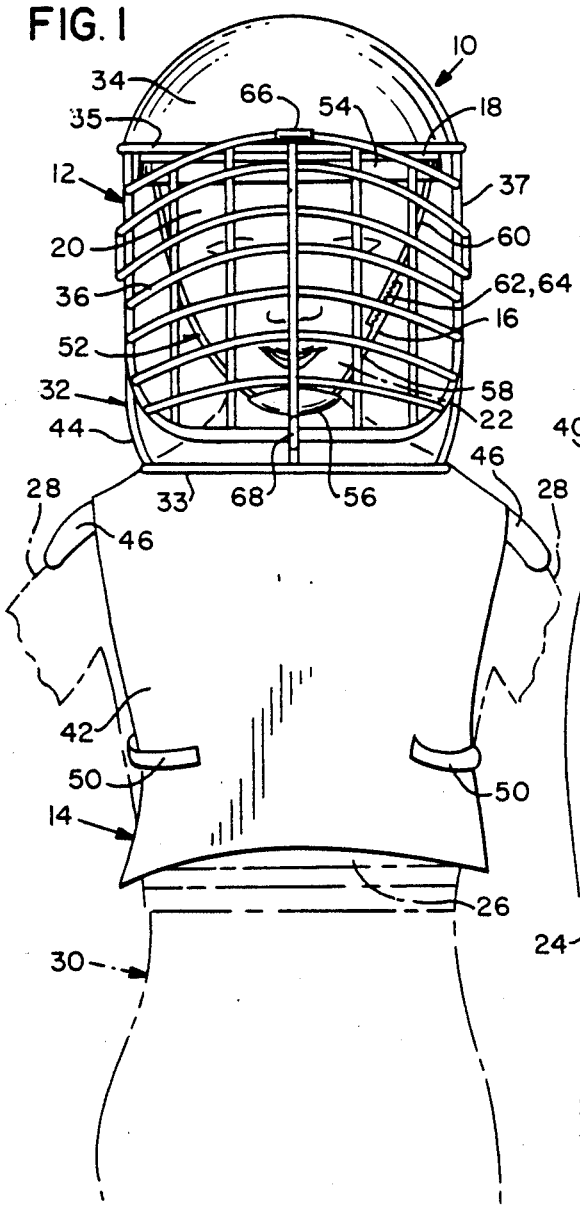
FIG. 1 is a front view of the instant invention illustrating a person in phantom.
Figure 2:
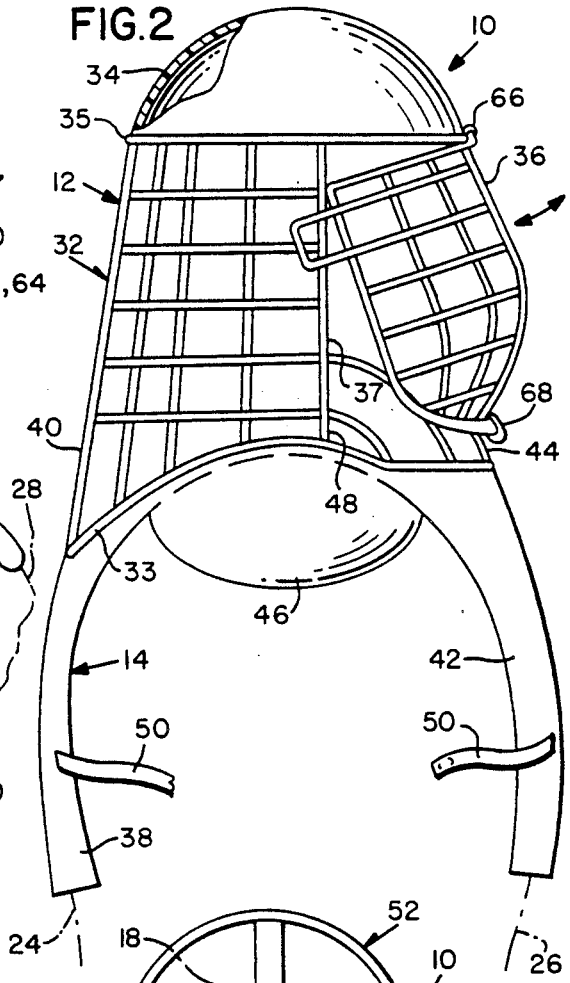
FIG. 2 is a side elevational view of the invention shown partly broken away.
Figure 3:
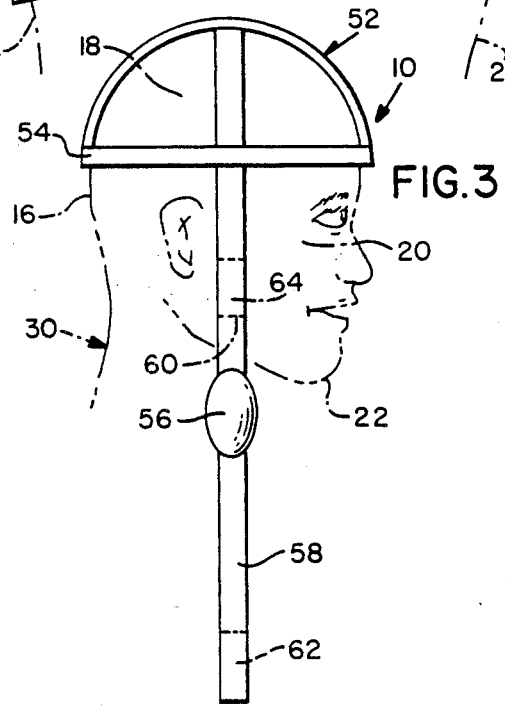
FIG. 3 is a side elevational view of the skull and chin protector on the person.

Turning now descriptively to the drawings, in which like reference characters denote like elements throughout the several views, FIG. 1 through 3 illustrate the invention being a combination helmet 12 and upper body protector 14 adapted to cover and protect head

16, skull 18, face 20, chin 22, back 24, chest 26 and shoulders 28 of a person 30.

The helmet 12 includes a cage 32 having a lower rim 33 carried on the shoulders 28 of the person 30. The cage 32 extends about but does engage with the head 16 of the person 30 so as to protect the head 16 and allow the person to move the head 16 independently from the cage 32 to see and hear therefrom. A dome shaped cap 34 is carried on top rim 35 of the cage 32 end extends over but does not engage with the skull 18 of the person 30 so as to protect the skull therein. A face mask 36 is carried on front 37 of the cage 32 and extends over but does not engage with the face 20 of the person 30 so as to protect the face.

The upper body protector 14 includes a back pad 38 is attached to and extends downwardly from lower rear side 40 of the cage 32 so as to protect the back 24 of the person 30. A chest pad 42 is attached to and extends downwardly from lower front side 44 of the cage 32 so as to protect the chest 26 of the person 30. A pair of shoulder pads 46 are also provided in which each extends outwardly from one lower side 48 of the cage 32 so as to protect one of the shoulders 28 of the person 30. Straps 50 extend between sides of the back pad 38 and the chest pad 42 so as to be secured together on upper body of the person 30.

As best seen in FIG. 3, a skull and chin protector 52 is utilized to be worn independently on the skull 18 and about the chin 22 of the person 30 so as to protect the skull and chin. The skull protector portion 54 is carried on the skull 18 while the chin protector portion 56 is wrapped around the chin 22 by straps 58 and 60 and attached by hook and loop fasteners 62 and 64.

The cage 32 and face mask 36 are both typically fabricated out of strong wire gauge material while the dome shaped cap 34 is typically fabricated out of durable plastic material. The face mask 36 is hinged at 66 to the top rim 35 of and latched locked at 68 near the bottom rim 33 of the cage 32 so that the face mask 36 can be lifted up away from the cage 32 when so desired by the person.

In operative use, the person simply puts on the skull and chin protector 52 first and then places the cage 32 with the dome shaped cap 34 over the head 16. The back pad 38 and chest pad 42 can then be secured by attaching the straps 50 together with the shoulder pads 46 in place. The person 30 can now move the head 16 independently from the cage 32 and dome shaped cap 34 when wearing the invention 10 so as to hear properly and have periphery vision therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination helmet and upper body protector for to covering and protecting head, skull, face, chin, back, chest and shoulders of a person wherein said helmet and upper body protector comprises:

(a) a cage having a lower rim for engaging with shoulders of the person and extending about but not touching the head of the person so as to protect the head while allowing the person to move the head independently from said cage to see and hear therefrom;

(b) a dome shaped cap carried on top rim of said cage and extending over but not engaging with the skull of the person so as to protect the skull therein;

(c) a face mask carried on front of said cage extending over but not engaging with the face of the person so as to protect the face;

(d) a back pad attached to and extending downwardly from lower rear side of said cage so as to protect the back of the person;

(e) a chest pad attached to and extending downwardly from lower front side of said cage so as to protect the chest of the person;

(f) a pair of shoulder pads, each extending outwardly from one lower side of said cage so as to protect one of the shoulders of the person; and (g) a plurality of straps extending between sides of said back pad and said chest pad so as to be secured together on upper body of the person.

2. A combination helmet and upper body protector as recited in claim 1, further comprising a skull and chin protector to be worn independently on the skull and about the chin of the person so as to protect the skull and the chin.

3. A combination helmet and upper body protector as recited in claim 2, further comprising:

(a) said cage fabricated out of strong wire gauge material;

(b) said dome shaped cap fabricated out of durable plastic material; and (c) means for hinging said face mask fabricated out of strong wire gauge material and hinged to said top rim of said cage and latched locked near said bottom rim of said cage so that said face mask can be lifted up away from said cage when so desired by the person.

* * * * *